United States Patent [19]

Seel et al.

[11] Patent Number: 4,653,748

[45] Date of Patent: Mar. 31, 1987

[54] BIOMECHANICAL ANKLE PLATFORM

[76] Inventors: Jerry E. Seel; Gary W. Gray, both of P.O. Box 56, Adrian, Mich. 49221

[21] Appl. No.: 651,653

[22] Filed: Sep. 17, 1984

Related U.S. Application Data

[63] Continuation of Ser. No. 431,276, Sep. 30, 1982, abandoned, which is a continuation-in-part of Ser. No. 269,601, Jun. 2, 1981, abandoned.

[51] Int. Cl.[4] ..... A63B 23/04

[52] U.S. Cl. ..... 272/96; 272/146

[58] Field of Search ..... 272/96, 97, 132, 111, 272/146, 112; 273/1 A, 26 R; 128/25 B; D21/191–198

[56] References Cited

U.S. PATENT DOCUMENTS

| | | | |
|---|---|---|---|
| D. 241,863 | 10/1976 | Friedl | D21/193 |
| 478,166 | 7/1892 | Madsen | 272/96 |
| 1,531,670 | 3/1925 | Levy | 272/96 |
| 3,021,137 | 2/1962 | Palmer et al. | 272/132 |
| 3,139,281 | 6/1964 | Nicholson | 273/1 A |
| 3,269,746 | 8/1966 | Jonker | 272/146 |
| 3,806,116 | 4/1974 | Malmberg et al. | 272/146 |
| 3,984,100 | 10/1976 | Firster | 272/96 |
| 4,186,920 | 2/1980 | Fiore et al. | 272/96 |
| 4,199,137 | 4/1980 | Giguére | 272/96 |

FOREIGN PATENT DOCUMENTS

| | | | |
|---|---|---|---|
| 2239545 | 8/1972 | Fed. Rep. of Germany | 272/146 |
| 510998 | 1/1955 | Italy | 272/97 |

*Primary Examiner*—Richard J. Apley
*Assistant Examiner*—S. R. Crow
*Attorney, Agent, or Firm*—Gifford, Groh, VanOphem, Sheridan, Sprinkle and Dolgorukov

[57] ABSTRACT

An ankle exercising device comprising a substantially flat platform and a hemispherical member secured to the bottom surface of the flat platform at its diametric planar surface. The peripheral contour of the platform is preferably configured with respect to the center of the hemispherical member so that the maximum tilt angle of the platform at any peripheral point coincides with the average or normal degree of movement of the biomechanical ankle structure in that direction. At least the top surface of the platform includes indicia so that the foot can be placed in a proper position on the platform, whereby angular movement of the ankle on the device corresponds with the average maximum biomechanical function of the ankle structure.

29 Claims, 10 Drawing Figures

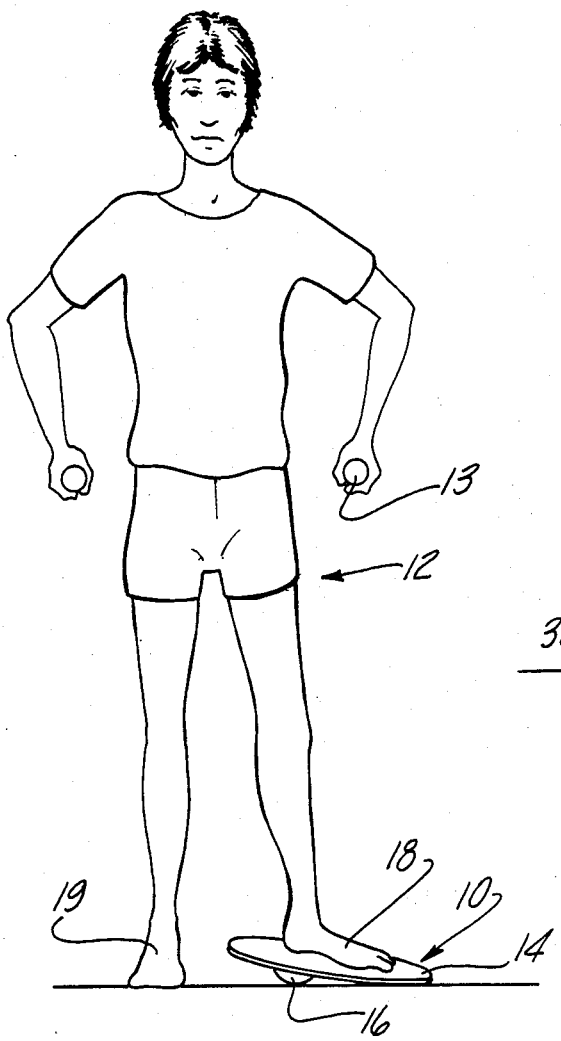
Fig-1
Fig-2
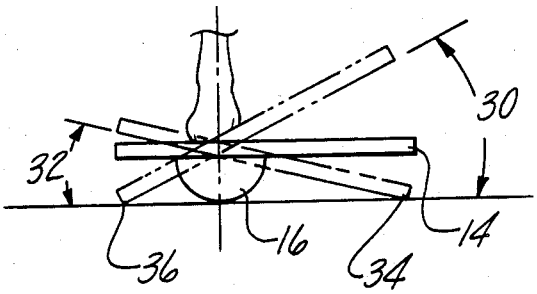
Fig-3
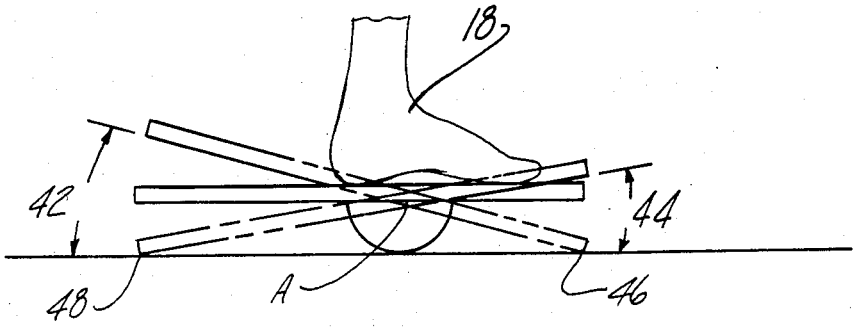

BIOMECHANICAL ANKLE PLATFORM

CROSS REFERENCE

This application is a continuation of our copending U.S. patent application Ser. No. 431,276, filed Sept. 30, 1982, now abandoned; which in turn was a copending continuation-in-part of our copending U.S. patent application Ser. No. 269,601, filed June 2, 1981, also abandoned.

BACKGROUND OF THE INVENTION

I. Field of the Invention

The present invention relates generally to conditioning and rehabilitation apparatus for controlling and developing body movements and, more particularly, to a device which is positioned under the foot to develop and retrain the ankle and its associated body parts.

II. Description of the Prior Art

The ankle is commonly known as the joint between the lower leg and the foot. The anatomical structure of the ankle includes a bone structure, muscles and tendons, ligaments and a neurological system. Typically, this anatomical structure permits movement of the ankle about two major axes with respect to the leg: dorsiflexion and plantar flexion occur about an axis which passes transversely through the body of the talus bone, while inversion and eversion occur about a longitudinal axis of the subtalar joint.

It is necessary to condition and rehabilitate the ankle by exercise so that the normal biomechanical movement and function is achieved and maintained. Such exercise is not only necessary to strengthen the muscles, maintain or increase stability of the ligaments and maintain or restore mobility to the ankle joint, but also to retrain the neurological sensors that control and respond to the operation of the other anatomical components. Although some devices for exercising the ankle joint are already known, they are of limited effectiveness and do not operate throughout the full range of mobility of the ankle joint.

For instance, the U.S. Pat. Nos. 3,789,836 to Girten and 3,638,645 to Kitada disclose exercise devices having moving pedals. The pedals move in a single vertical plane and thus are not concerned with mobility of the ankle joint in all directions in which it is anatomically capable of movement. Moreover, these devices are motorized and, therefore, do little to affect the muscular strength or the natural neurological processes which produce and respond to normal biomechanical movements.

Another known ankle exercise device is disclosed in U.S. Pat. No. 3,774,483 to Picolin. Picolin discloses a floormat wherein an upper layer of the floormat is a sinusoidally contoured mat that is attachable to a flat lower mat. The direction and degree of ankle movement is determined by the position at which the foot is placed on the mat and the foot placement positions are not strictly designated on the floor. Thus, Picolin does not disclose an exercise device which is calibrated to produce ankle movements corresponding to normal biomechanical movements of the ankle. Moreover, the foot must be repeatedly removed and repositioned in order to exercise the ankle throughout its normal range of movements.

SUMMARY OF THE PRESENT INVENTION

The present invention overcomes the above-mentioned disadvantages by providing an ankle exercise platform mounted on a hemispherical member to permit movement of the ankle in all of its normal biomechanical operations. In addition, the device is calibrated to be sure that the movements correspond to the normal biomechanical movements of a healthy ankle. The device not only increases mobility, strength, endurance and coordination of movement of the muscles, tendons, ligaments and joint capsule, but also restrains and resensitizes the neurological structure and enables the neuro fibers to respond to mechanical, postural and positional stresses in the tissues. The device also permits the application of controlled, calibrated and proportionally variable stress to the ankle joint throughout its normal range of biomechanical movement.

Thus, unlike previously known ankle exercising devices, the ankle platform provides controlled and variable exercise throughout the full range of normal movement incident to the biomechanical structure of the ankle. Therefore, throughout the entire range of movement, the muscles are conditioned with respect to strength, endurance, mobility, speed of contraction and coordination of movement. Similarly, the stability provided to the ankle joint by the ligaments is preserved, the articular nerves in these ligaments responsive to mechanical and postural stresses in the tissues being stimulated to reinforce and reeducate the reflexogenic and kinesthetic functions of these fibers. In addition, proprioceptors, the type of intero-ceptors that receive and transmit impulses from the muscles, tendons, joint capsule and ligaments concerning the position and movements of the body, are stimulated and retrained to provide a feedback system for a flow of information toward the central nervous system concerning proper positioning and coordination of movements.

The exercising device comprises a substantially flat platform having a hemispherical member secured to its lower surface at the flat diametric surface of the hemispherical member. Preferably, the platform is a disk having a contour with a predetermined shape which corresponds to predetermined spacial relationships from the center of the hemispherical member, while the top surface of the platform includes alignment indicia which correspond to said axes normally associated with the movements incident to the biomechanical structure of the ankle. Accordingly, once the foot is positioned in its predetermined spot on the platform, angular movements of the platform correspond to the normal ankle movements dictated by the biomechanical structure of the ankle.

The amount of stress on the ankle can be varied by changing the weight-bearing status of the exercising person, i.e. varying the amount of pressure with which the foot is engaged against the platform, as well as by changing the radius of the hemispherical number. In addition, a preferred modification of the device includes means for detachably securing weights to the platform to adjust the force necessary to manipulate the platform.

BRIEF DESCRIPTION OF THE DRAWING

The present invention will be better understood by reference to the following detailed description of a preferred embodiment of the present invention when read in conjunction with the accompanying drawing in which:

FIG. 1 is a perspective view of the ankle exercising device of the present invention being used by the patient;

FIG. 2 is a side plan view taken substantially along arrow 2 in FIG. 4;

FIG. 3 is a side plan view taken substantially along arrow 3 in FIG. 4;

DETAILED DESCRIPTION OF A PREFERRED EMBODIMENT OF THE PRESENT INVENTION

Figure 4:
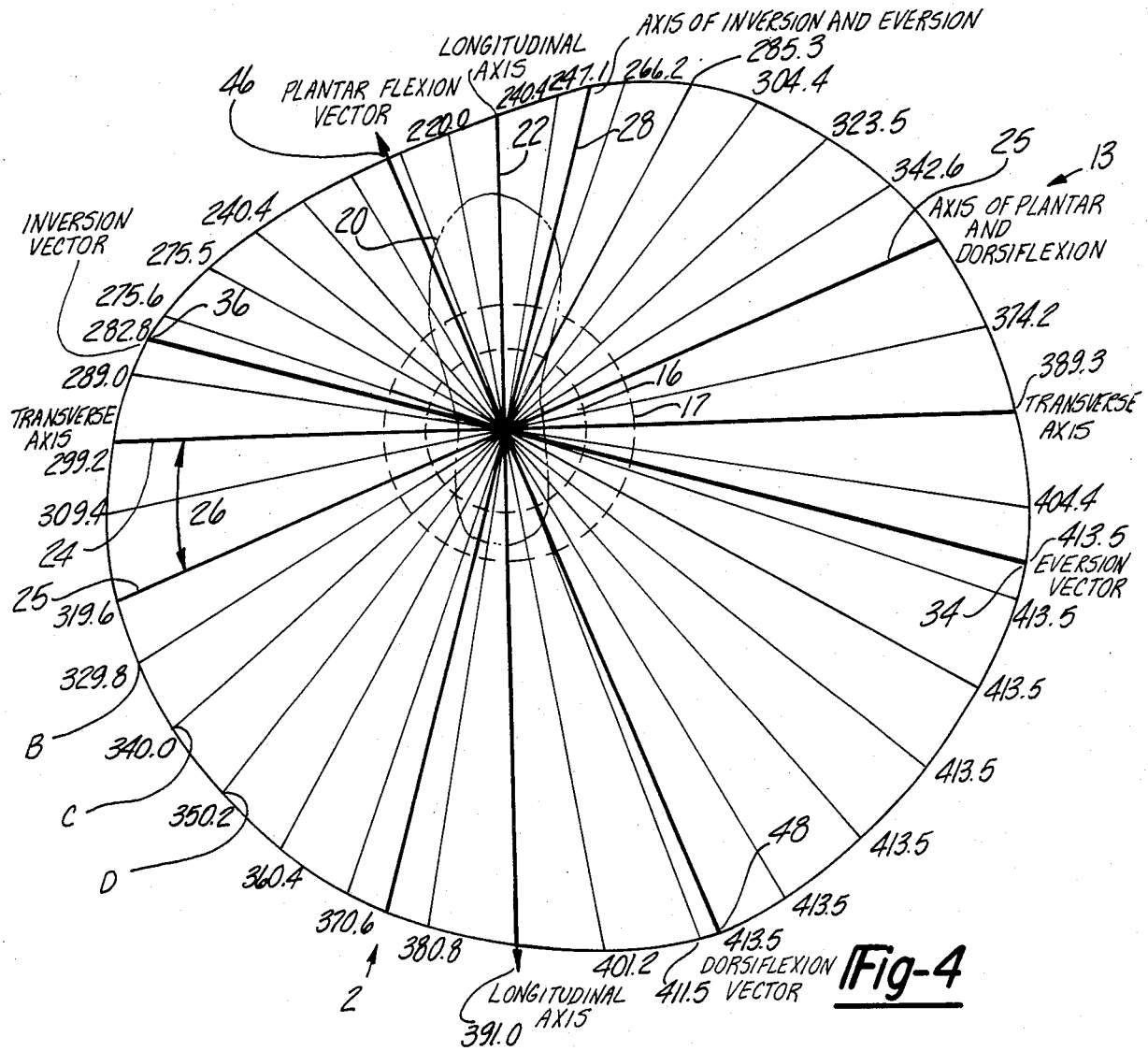
FIG. 4 is a top plan view of the ankle exercising device shown in FIGS. 1 through 3.

Referring first to FIG. 1, an ankle exercising device 10 according to the present invention is thereshown as it is used by a person 12. The device 10 includes a substantially flat platform 14 and a hemispherical member 16 secured to the bottom surface of the platform 14. As shown, the left foot 18 of the person 12 is placed upon the top surface of the platform 14.

Referring now to FIG. 4, the placement of the foot 18 on the platform 14 is indicated diagrammatically by the outline 20. The outline 20 is aligned on the longitudinal axis, the longitudinal axis being defined as the axis lying in the sagittal plane which passes through the second metatarsal of the foot. In addition, the outline 20 is aligned on the axis which passes through the tips of the malleoli and which normally intersects the longitudinal axis at an angle of 68° anterio-medially. These axes can be indicated by indicia marks 22 and 25 so that foot placement is easily recognizable on the surface of the platform 14. In any event, it can be seen that the hemispherical member 16 is centrally aligned on the vertical axis (not shown) extending through the intersection of the longitudinal and transverse axes of the ankle joint.

As also shown in FIG. 4, the platform 14 is designed to accommodate the actual movements permitted by the biomechanical structure of the ankle. In this respect, it will be noted that the axis about which the angular movement of planar flexion and dorsiflexion occur is slightly offset from the transverse axis of dorsiflexion and plantar flexion is substantially 22° posterio-lateral to the transverse axis 24 as indicated by reference character 26. Furthermore, the actual axis about which the angular movements of inversion and eversion occur is offset from the longitudinal axis of the joint. The position of the average longitudinal axis of inversion and eversion is an axis that is substantially 16° anterior-medial to the longitudinal axis as indicated by the reference character 28.

Referring now to FIG. 2, the angular movements of inversion and eversion are thereshown. Reference character 30 indicates the maximum angle of inversion while reference character 32 refers to the maximum angle of eversion. It can be seen that the disk is appropriately sized by dimensioning the platform 14 so that the distance between the center point A of the hemispherical member 16 to the peripheral edge of the platform 14 produces the appropriate angle 30 or 32 when the peripheral edge engages the ground surface 40. Since the average angle of inversion is about 30° and the average angle of eversion is about 20°, it can be seen that the right hand edge of the platform 14 is spaced farther from the center point A than the left peripheral edge of the platform 14 as shown in FIG. 2.

Referring now to FIG. 3, the angular ankle joint movements of dorsiflexion and plantar flexion are thereshown. Reference character 42 indicates the maximum angle of plantar flexion while the reference character 44 refers to the maximum angle of dorsiflexion. Since the average angle of plantar flexion 42 is 40° and the average angle of dorsiflexion is 20°, it can be seen that the right hand peripheral edge point 46 is spaced apart from the center point A a distance less than the distance between the center point A and the left hand peripheral edge point 48.

Referring again to FIG. 4, it can be seen that the peripheral edge of the platform 14 between the points 36, 46, 34, 48 and 36 is continuous and the curvature of these sections is determined in accordance with the average biomechanical angle of movement along the radians of each sector. This curve can be formed by accurately measuring the distance from the point A along the particular radians to determine the distance to several points, such as the points B, C and D, on the periphery of the platform 14 and by merely making a continuous peripheral surface between these points. The numerical values illustrated at the periphery of the platform in FIG. 4 indicate appropriate radial lengths in millimeters for a platform secured to a hemispherical member having a radius of about 141.6 millimeters to produce angular ankle displacements corresponding to the average limits of biomechanical function.

The contour of the peripheral edge can also be expeditiously formed by defining the curve between movement vectors in relation to the relative lengths of the vectors and the manner in which the ankle joint components function. First of all, the curve is defined as positive or negative with respect to an adjacent vector depending upon whether the distance between the edge and the fulcrum, i.e. the radius increases or decreases, respectively, as the edge extends toward the adjacent vector. Secondly, the curvature accelerates or decelerates as the change in the radius increases or decreases, respectively, as the edge approaches an adjacent vector. Acceleration and deceleration, as defined herein, are required because of the complex structure which provides total ankle movement. In particular, total ankle movement results from the interaction between the subtalar ankle joint and the midtarsal joint. Use of acceleration and deceleration takes into account the fact that movement about the plantar flexion/dorsiflexion axis 25 dominates movement about the inversion/eversion axis 28 within a wide range of the plantar flexion vector 46 and the dorsiflexion vector 48.

In the preferred embodiment shown in FIG. 4, the curvature between the plantar flexion vector 46 and the axis of inversion and eversion 28 is a positive accelerating curve, wherein the distance r from the fulcrum to the edge increases as one moves from the plantar flexion vector 46 to the axis of inversion and eversion 28 and wherein the amount of the increase becomes greater as the curvature nears the axis of inversion and eversion 28. The curvature from the axis of inversion and eversion 28 to about the transverse axis is positive and constant; i.e. the distance r increases at a constant rate. From the transverse axis to the eversion vector 34 the curvature is positive decelerating as the radius still increases but by smaller increments. vector 34 and the dorsiflexion vector 48 is conveniently contoured as a circular arc with a constant distance r.

The curvature from the dorsiflexion vector 48 to the inversion vector 36 is a negative constant curve, where r decreases by a constant amount. From the inversion vector 36 to the plantar flexion vector 46 the curve is negative and decelerating as r decreases and the increments become smaller.

Figure 5:
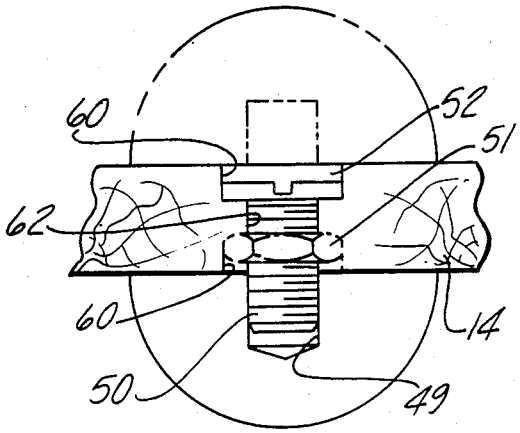
FIG. 5 is a fragmentary sectional view of a portion of the ankle exercising device shown in FIGS. 1–3 and enlarged for clarity.

Although the peripheral contour of the platform 14 is fixed relative to the center point A, it will be understood that the angle through which the ankle joint is manipulated by engagement of a peripheral edge portion of the platform with the ground surface can be increased or decreased by varying the diameter of the hemispherical member 16. It can be seen that enlarging the diameter of the hemispherical member 16 increases the angle between the plane of the platform and the ground surface. Conversely, decreasing the diameter of the hemispherical member 16 decreases the angle between the plane of the platform and the ground surface when the peripheral edge of the platform 14 engages the ground surface 40. Consequently,. the hemispherical member 16 is preferably removably secured to the bottom surface of the platform 14. For example, as shown in FIG. 5, the hemispherical member 16 can be provided with a threaded recess 49 adapted to receive the protruding end portion of a threaded fastener 50 which is embedded or countersunk in the platform 14 and secured in place by the removable cover plug 52. Alternatively, the fastener 50 can be secured in position by the nut 51.

In addition, the platform is preferably reversible so that the same platform can be used with right or left feet. For this reason, a counterbore portion 60 is provided at each end of the throughbore 62 so that the fastener 50 can be installed from either surface and can correspondingly secure the hemispherical member to either surface. Of course, it will be understood that in this case, indicia designating the axes and displacement vectors are provided on both surfaces, and that the indicia are aligned at the same positions on both surfaces.

Figure 6:
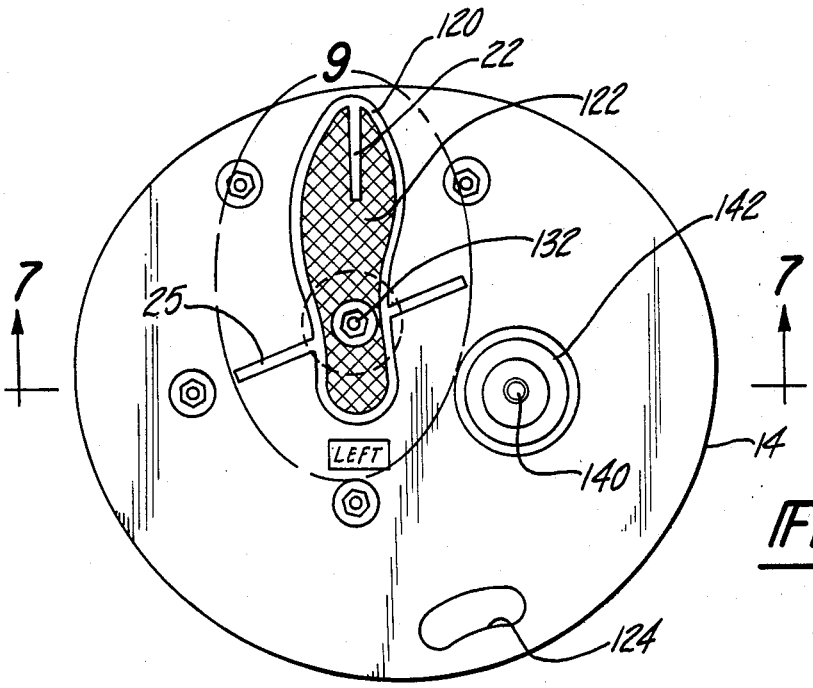
FIG. 6 is a top plan view of the ankle exercising device and showing modifications thereof.
Figure 7:
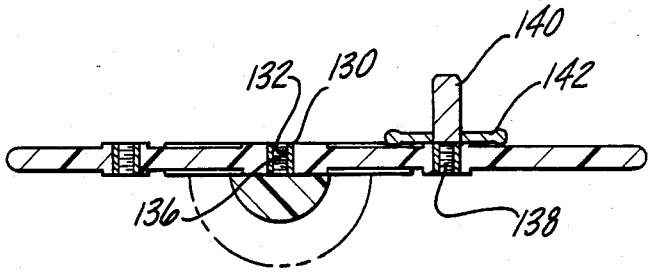
FIG. 7 is a sectional elevation of the ankle exercising device shown in FIG. 6.
Figure 8:
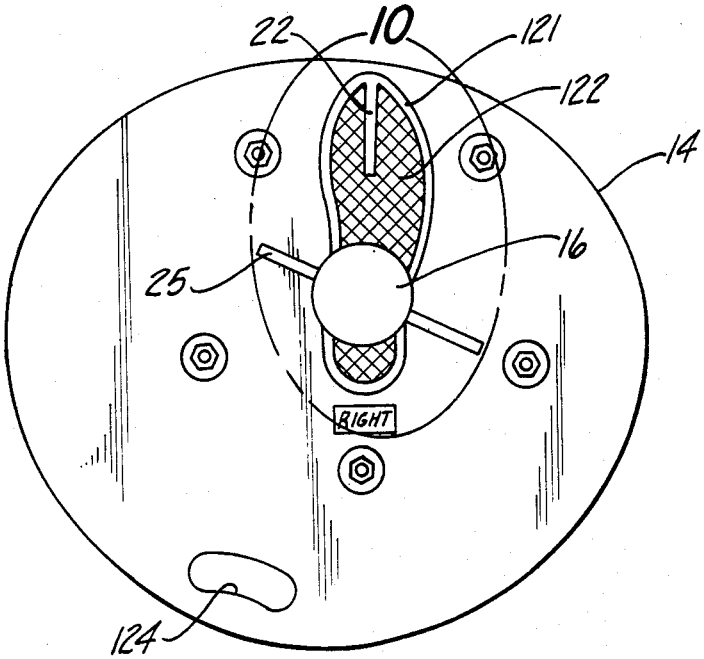
FIG. 8 is a bottom plan view of a portion of the device shown in FIGS. 6 and 7.
Figure 9:
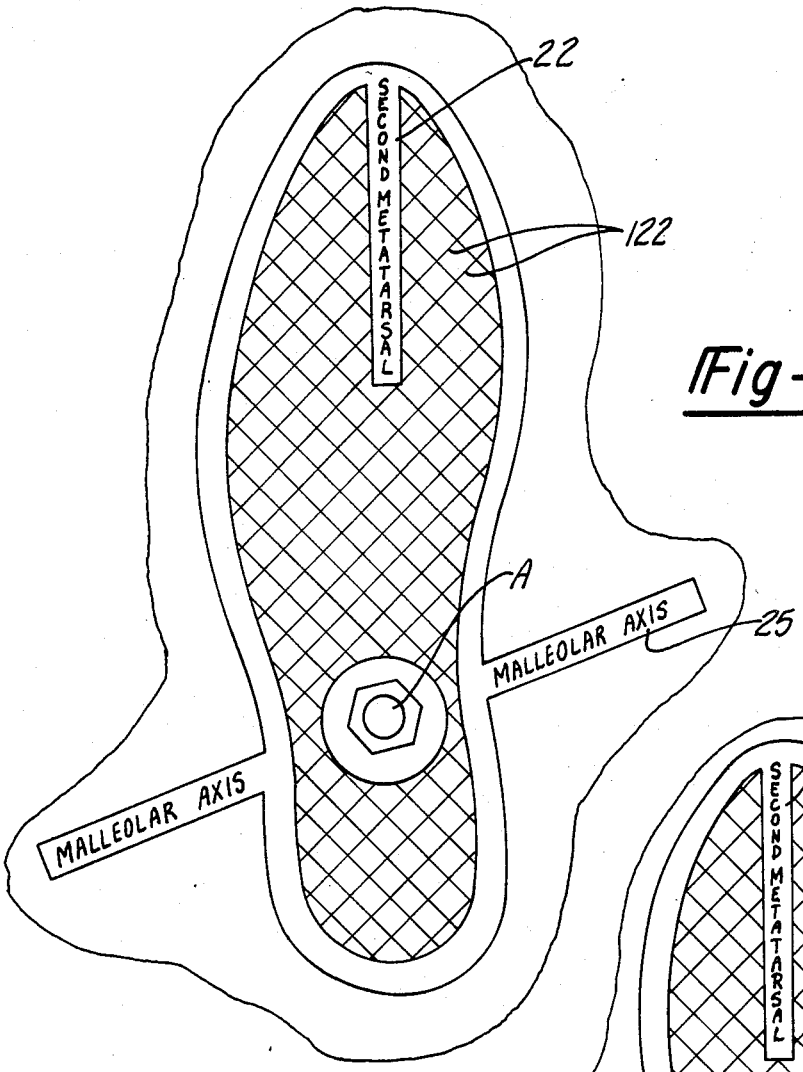
FIG. 9 is an enlarged plan view of a portion of the device shown in FIG. 6.
Figure 10:
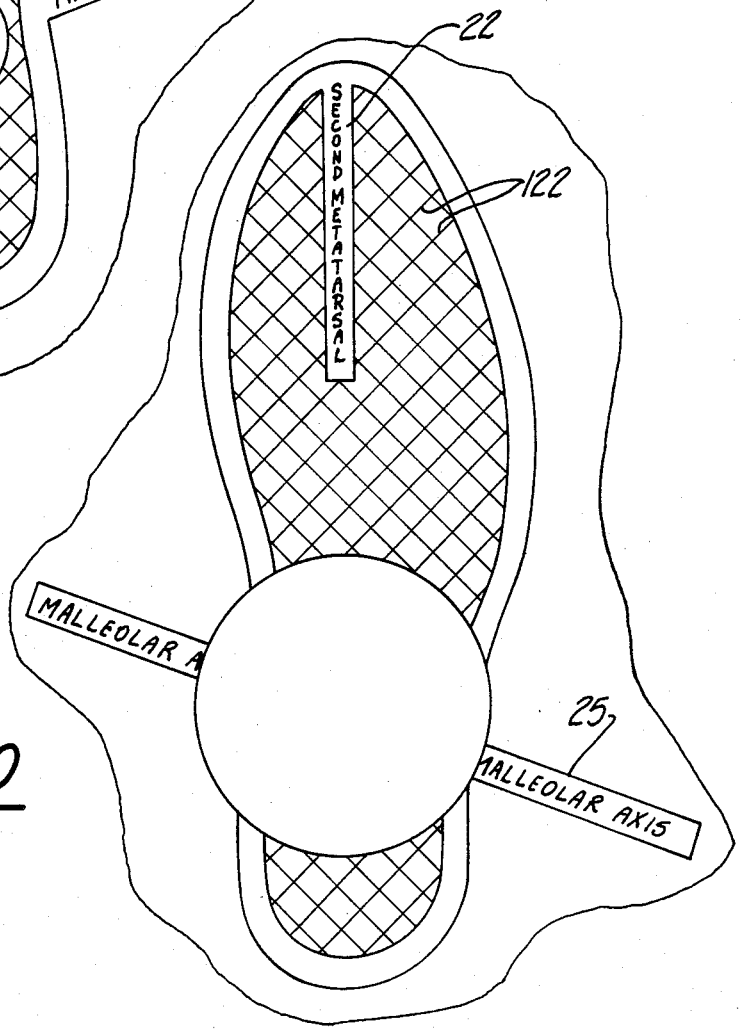
FIG. 10 is an enlarged plan view of a portion of the device shown in FIG. 8.

Referring now to FIGS. 6–8, several additional advantageous features in the exercising device are shown. The platform 14 is molded from a hard plastic material, which can be readily sanitized, to include a footrest 120 for the left foot on one side, and a footrest 121 for the right foot on the other side, each footrest 120 and 121 including indicia 22 and 25. Preferably, each footrest 120 and 121 includes cross ribs 122 or other means to prevent slippage of the foot on the platform, which can occur due to perspiration or humid environmental conditions. The platform 14 is also molded to include an elongated aperture 124 near the peripheral edge of the platform 14 to form a carrying handle along the edge. In addition, the molded platform can also include additional indicia such as the foot designation marks 126.

As shown in FIG. 6–8, a sleeve 130 having a threaded bore 132 is lockingly embedded in the platform at point A, with the ends of the sleeve remaining open at opposite sides of the platform. As shown in FIGS. 6 and 8, the sleeve 130 includes hexagonal peripheral portions in order to prevent rotation of the sleeve 130 with respect to the platform 14. The hemispherical member 16 includes a threaded stud 136 engageable within the sleeve 130 from either end. Additional sleeves 131 having threaded bores are embedded at other positions on the platform 14 to receive the threaded end 138 of a weight retaining rod 140. The rod 140 is appropriately sized to fit within the center hole of a conventional weight disc 142 used in barbells, although other weighting devices are equally within the scope of the present invention. While the sleeves 131 can be provided at predetermined points coinciding with the biomechanical axes and vectors previously discussed for controlled application of stress to the ankle, even random positioning will enable the weights 142 to be used to increase the inertia of the board. In addition, when the sleeves 131 are the same size as the sleeve 130, the hemispherical members 16 can also be repositioned to facilitate a particular exercise deemed necessary by a therapist.

Having thus described the important structural features of the present invention, the operation of the exercising device 10 can be readily described. The person whose ankle is to be exercised lays the device 10 on the ground surface so that the hemispherical member 16 engages the ground surface. The device can be placed between raised parallel bars 13, as shown in FIG. 1, or near a wall, chhair or other relatively stationary object so that the person can stabilize or partially support himself while standing astride the board. The person 12 then places his left foot 18 upon the surface of the board so that the vertical axis of the ankle joint (see FIG. 2) is substantially aligned with the point A, the second metatarsal is aligned on the longitudinal axis, and the tips of the malleolus are aligned on axis 25. Of course, the point A is aligned at the intersection of the longitudinal and transverse axes which are preferably designated by the indicia 22 and 24 on the upper surface of the disk 14.

Once the foot is in position, the ankle can be exercised. Maximum weight bearing status is achieved when the other foot 19 is lifted completely off the ground so that the person's total weight is supported by the ankle astride the device. In this preferred, ipsilateral position, the stress on the ankle can still be lessened by having the person support himself upon the bars 13. Alternatively, the person can assume a bilateral position so that the weight is partially supported by his other leg. The device can also be placed in front of a chair, bench or the like so that the person can be seated. In this position, substantially no weight is borne by the ankle on the device, and stress on the ankle is minimized. In any event, it can be seen that the weight bearing status can be widely varied and that the device is operable regardless of the protocol which is determined to be most beneficial to a particular person by a skilled trainer.

It can also be seen that manipulating the device 10 so that the peripheral edge of the platform 14 continuously engages the ground surface at one continuously changing, peripheral point forces the ankle to conform to various positions. When the platform is preferably configured as described in the preferred embodiment, motions of the ankle coincide with the biomechanical functions. In addition, varying the size of the hemispherical member 16 by replacing it with another hemispherical member 17 having a different size affects the maximum movements capable of being made by the ankle which is placed on the device. For example, it will be understood that a fixed proportion of the maximum angle 42 will be achieved by substituting a reduced diameter hemispherical member, and that the angle 44 will also be reduced by the same fixed proportion. Thus, it can be seen that the device is readily adapted for use by many persons regardless of the particular protocol of treatment deemed necessary for the ankle joint.

In any event, it is clear that the ankle exercise platform of the present invention can be used to educate and train or reeducate and retrain the neurological processes of the ankle joint while the same time increasing the strength and mobility of the ankle structure under variable yet highly controllable conditions. Although the device shown in FIGS. 1-5 is specifically designed for use with a person's left foot, it will be readily understood from FIGS. 6-10 that a configuration for the right foot is substantially a mirror image of the device shown so that the platform is reversible upon repositioning of the hemispherical member, and any weight rods, from side of the platform to the opposite side, respectively, of the platform. Moreover, it will be understood that the average dimensional requirements of the structure can be changed so that the device can be particularly adapted for use by a particular person whose ankle structure may not strictly conform with the average biomechanical structure. In addition, the amount of stress exerted on the ankle can be mechanically or posturally varied.

Having thus described the present invention, many modifications thereto will become apparent to those skilled in the art to which it pertains without departing from the scope and spirit of the invention as defined in the appended claims.

What is claimed is:

1. An apparatus for developing and retraining muscular and neurological physiology of the ankle comprising:

a substantially flat platform;

a hemispherical member secured at its planar wall to one surface of said flat platform; an wherein said platform includes a peripheral edge having a predetermined contour, said contour being curved but not circular and comprising the locus of points defined by a predetermined set of radial distances and angular directions emanating from the center of said planar wall of said hemispherical member substantially as shown in FIG. 4.

2. The invention as defined in claim 1 wherein said platform is substantially wider than the diameter of said hemispherical member.

3. The invention as defined in clam 1 wherein said hemispherical member is resilient.

4. The invention as defined in claim 1 wherein said platform includes straight line indicia designating particular predetermined axes and wherein at least a portion of said indicia delineate the longitudinal axis and the dorsiflexural-plantar flexural axis.

5. The invention as defined in claim 1 wherein said indicia is provided on the upper and lower surfaces of said platform.

6. The invention as defined in claim 4 wherein said indicia includes a line perpendicular to the axis about which plantar flexion and dorsiflexion of the ankle occur to thereby designate the maximum average vector of dorsiflexion and plantar flexion.

7. The invention as defined in claim 6 wherein said indicia is provided on the upper and lower surfaces of said platform.

8. The invention as defined in claim 4 wherein said indicia includes a straight line corresponding to the axis about which inversion and eversion of the ankle occur.

9. The invention as defined in claim 8 wherein said indicia is provided on the upper and lower surfaces of said platform.

10. The invention as defined in claim 7 wherein said indicia includes a straight line perpendicular to said last mentioned axis to thereby designate the maximum average vector along which inversion and eversion occur.

11. The invention as defined in claim 10 wherein said indicia is provided on the upper and lower surfaces of said platform.

12. The invention as defined in claim 1 and further comprising means for removably securing said hemispherical member to said platform.

13. The invention as defined in claim 12 wherein said means for removably securing said hemispherical member includes means for removably securing said hemispherical member to either of the upper and lower surfaces.

14. The invention as defined in claim 12 wherein said platform includes a throughbore having an expanded countersink portion at each end, and further comprising a bolt insertable in said throughbore so as to extend outwardly from a surface of said platform, and wherein said hemispherical member includes a threaded recess adapted to receive the extended portion of said bolt.

15. The invention as defined in claim 1 and further comprising means for supporting at least one weighted member on said platform.

16. The invention as defined in claim 15 wherein said means for supporting comprises at least one sleeve secured to said platform, a rod, and a bore in said sleeve adapted to receive an end of said rod.

17. The invention as defined in claim 16 wherein said sleeve is embedded in said platform.

18. The invention as defined in claim 16 wherein said sleeve is open at both ends, said ends being exposed from opposite sides of said platform.

19. The invention as defined in claim 16 wherein said bore and said end of said rod are correspondingly threaded.

20. The invention as defined in claim 15 wherein said means for supporting comprises means for positioning said weights at at least one of a plurality of predetermined positions.

21. The invention as defined in claim 20 wherein said means for positioning comprises a plurality of sleeves secured to said platform, and at least one rod having an end portion adapted to be received within said sleeve.

22. The invention as defined in claim 1 wherein said platform includes a handle.

23. The invention as defined in claim 22 wherein said handle comprises an aperture extending through said platform near but radially inwardly of the peripheral edge of the platform.

24. The invention as defined in claim 15 wherein said weighted member comprises a conventional weight disc.

25. An apparatus for developing and retraining muscular and neurological physiology of the ankle comprising:

a substantially flat platform; and a fulcrum means for tilting said platform on a floor surface, said fulcrum means being secured at predetermined point on one surface of said flat platform;

wherein said platform includes a peripheral edge having a predetermined contour, said contour being curved but non-circular and comprising the locus of points defined by a predetermined set of radial distances and angular directions emanating from said predetermined point substantially as shown in FIG. 4.

26. An exercise and neurophysical training apparatus employable by a user, said user having a foot possessing a malleolar axis and a second metatarsal axis intersecting said malleolar axis at an intersection point, and said user also having an ankle about which said foot is continuously and omnidirectionally movable within a maximum extent defined by a dorsiflexural direction limit, a planar flexural direction limit, an eversional direction limit, and an inversional direction limit, said limits being those of an average healthy user; said apparatus comprising:

a substantially flat platform having a pair of faces and a continuous circumferential edge;

indicia means on at least one of said faces designating said intersection point of said malleolar and second metatarsal axes, and designating a foot position location over said point; and fulcrum means for tilting said platform securable to at least the other of said faces opposite said intersection point, such that said edge and said fulcrum means are abuttable against a floor surface when said foot of said user rests on said foot position location;

wherein said edge includes:

a first means for limiting movement of said foot, in said dorsiflexural direction, to said dorsiflexural direction limit;

a second means for limiting movement of said foot, in said planar flexural direction, to said planar flexural direction limit;

a third means for limiting movement of said foot, in said eversional direction, to said eversional direction limit; and a fourth means for limiting movement of said foot, in said inversional direction, to said inversional direction limit wherein said four limiting means are defined by four corresponding portions of said edge, and wherein said four corresponding edge portions define four corresponding average distances from said edge to said point, at least three of said corresponding average distances being different from each other.

27. The invention as defined in claim 26, wherein said first, second, third and fourth limiting means comprise a first, second, third and fourth portion respectively of said edge, and wherein said first, third and fourth portions are spaced from said intersection point a respective distance allowing a maximum inclination of said platform from the horizontal of about 20 degrees, 40 degrees, 20 degrees and 30 degrees, respectively, when said first, second, third and fourth portions, engage said floor surface.

28. The invention as defined in claim 26, wherein said edge is shaped first as a positive accelerating curve then as a positive decelerating curve from said second to said third limiting means, as a negative decelerating curve from said fourth to said second limiting means, as a positive decelerating curve from said fourth to said first limiting means, and as a circularly arcuate curve from said third to said first limiting means.

29. An exercise and neurophysical training apparatus employable by a user, said user having a foot possessing a malleolar axis and a second metatarsal axis intersecting said malleolar axis, and said user also having an ankle about which said foot is continuously and omnidirectionally movable within a maximum extent defined by a dorsiflexural direction limit, a plantar flexural direction limit, an eversional direction limit, and an inversional direction limit, said limits being those of an average healthy user; said apparatus comprising:

a substantially flat platform having a pair of faces and a continuous circumferential edge;

indicia means on at least one of said faces designating said intersection point of said malleolar and second metatarsal axes, and designating a foot position location over said point; and fulcrum means for tilting said platform securable to at least the other of said faces opposite said intersection point, such that said edge and said fulcrum means are abuttable against a floor surface when said foot of said user rests on said foot position location;

wherein said edge includes:

a first means for limiting movement of said foot, in said dorsiflexural direction, to said dorsiflexural direction limit, a second means for limiting movement of said foot, in said planar flexural direction, to said planar flexural direction limit;

a third means for limiting movement of said foot, in said eversional direction, to said eversional direction limit; and a fourth means for limiting movement of said foot, in said inversional direction, to said inversional direction limit; and wherein said third and fourth limiting means are disposed opposite from each other across said intersection point; wherein a line between said first and second limiting means through said intersection point is posterio-laterally offset substantially 22 degrees from a longitudinal axis defined by the intersection of said at least one face and a sagittal plane passing through said second metatarsal axis; and wherein a line between said third and fourth limiting means through said intersection point is posterio-laterally offset substantially 74 degrees from said longitudinal axis.

* * * * *